US005246037A

United States Patent [19]

Degen et al.

[11] Patent Number: 5,246,037

[45] Date of Patent: Sep. 21, 1993

[54] CLEARING MISPICKS IN RAPIER LOOMS

[75] Inventors: Werner Degen, Jona; Hanspeter Bolt, Steg im Tösstal; Walter Stark, Galgenen, all of Switzerland

[73] Assignee: Sulzer Brothers Limited, Winterthur, Switzerland

[21] Appl. No.: 862,848

[22] Filed: Apr. 3, 1992

[30] Foreign Application Priority Data

Jun. 4, 1991 [CH] Switzerland ..... 01658/91

[51] Int. Cl.[5] ..... D03D 51/08

[52] U.S. Cl. ..... 139/116.2; 139/446; 139/447

[58] Field of Search ..... 139/116.2, 446, 447

[56] References Cited

U.S. PATENT DOCUMENTS 5,080,144 1/1992 Takehana ..... 139/116.2

5,158,120 10/1992 Kaufmann et al. ..... 139/116.2

FOREIGN PATENT DOCUMENTS 0332257 9/1989 European Pat. Off. .

*Primary Examiner*—Andrew M. Falik

*Attorney, Agent, or Firm*—Townsend and Townsend Khourie and Crew

[57] ABSTRACT

Weft yarn faults encountered during the operation of rapier looms are corrected by correlating the detection of the fault to the angular position of the rotating main shaft of the loom. The loom has a shed with a giver side and a taker side, a giver rapier at the giver side and a taker rapier at the taker side. Position signals are stored in an electronic storage device for weft yarn faults which can occur at predetermined angular positions of the main shaft during operation of the loom. The weft yarn is monitored and a signal is generated when a faulty weft yarn is detected. This signal is compared with the position signals in a logic circuit to thereby determine the nature of the fault. After the nature of the fault has been determined, the faulty weft yarn is appropriately removed and, thereafter, weaving continues.

21 Claims, 8 Drawing Sheets

CLEARING MISPICKS IN RAPIER LOOMS

BACKGROUND OF THE INVENTION

The invention relates to a method of clearing mispicks in rapier looms as set out in the preamble of claim 1 and to a loom having means for the practice of the method.

A known method of this kind (EP-PS 332,257) discloses the clearance of a weft breakage in the shed by detaching the weft yarn from the fell and drawing out the faulty yarn parts by means of the loom rapiers and an extractor. The disclosure is silent about how the fault is detected while the loom is running and how weaving resumes after clearance of the fault, nor is anything said about the numerous other faults which may occur in the picking of a weft yarn and how they could be cleared.

SUMMARY OF THE INVENTION

It is therefore the object of the invention to provide a method of the kind defined enabling all or at least most of the mispicks which can occur to be detected by the loom itself, whereupon the loom itself clears the fault, depending upon the nature thereof, and whereafter the loom resumes weaving.

It is another object of the invention to provide a loom of the kind defined which has means for the practice of the respective fault-clearing method.

In the method of clearing mispicks in the shed of a rapier loom, the loom itself determines the nature of the fault in the time slot allocated to faults of this nature in the continuously produced signals corresponding to the angular position of the loom on the basis of the combination of such signals arising in such slots and of the weft movement and weft presence signals produced in the slot by the nature of the fault, whereafter the loom automatically acts to clear the fault and resumes weaving after the clearance thereof.

DESCRIPTION OF THE PREFERRED EMBODIMENTS

1. Drive faults (FIG. 1)

The term "drive faults" denotes a fault in which the giver has entered the shed without a weft yarn in its rapier. This kind of fault will be described with reference to FIG. 1. The short description used in this case of the arrangement around the shed applies to all the subsequent figures of the drawings (facilities mentioned hereinafter will be described in connection with the associated figures of the drawings).

Figure 1:
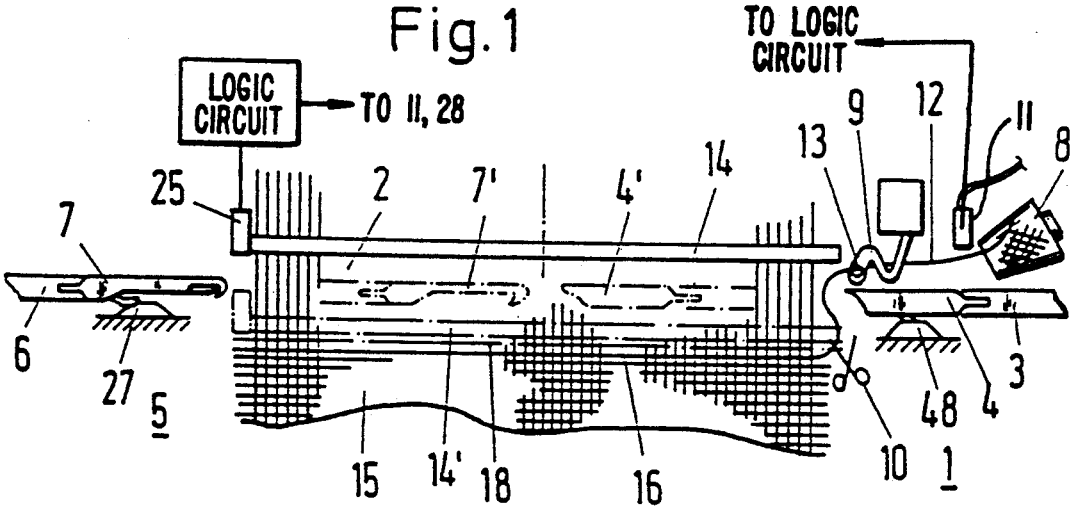
FIG. 1 is a front elevational view of a rapier loom constructed according to the present invention and shows the clearing of "drive faults"

Referring to FIG. 1, a weft yarn giver 3 having a giver rapier 4 is disposed on side 1 of a shed 2 of a rapier loom and a weft yarn taker 6 having a taker rapier 7 is disposed on the other side 5 of the shed. Also disposed on side 1 of the shed are a yarn supply bobbin 8, a yarn thrower 9, shears 10 and a weft yarn monitor 11. The same monitors the weft yarn 12 coming off the bobbin 8. The weft yarn 12 goes through a yarn guide 13 of thrower 9. There can be seen a reed 14 (14' denoting the reed shown in chain-dotted lines during beating-up) and cloth 15. The cloth has a fell 16—i.e., the weft yarn last picked and beaten up by the reed. The shears 10 have not yet severed the latter weft yarn. A chain-dotted line 18 denotes the weft yarn which should have been picked but which was not introduced into the shed by the giver. To pick the weft yarn the giver rapier 4 and taker rapier 7 were moved to the center 19 of the shed into respective positions 4' and 7'. Cams 27, 48 for the two rapiers 27, 48 respectively are disposed outside the shed. A second weft yarn monitor 25 is disposed on the reed 12 on the taker side.

The phase of loom operation is referred in conventional manner to the angular position of the loom main shaft, such position being referred to as the angular position of the main shaft of the loom in degrees and abbreviated "MGR". The start of the loom cycle or the 0° position=reference position, is, for example, the beating-up position of the reed on the cloth and the rapier reversal position in its initial position. The 0° position can of course be chosen in some other way.

The absence of weft yarn is detected by the monitor 11 in the MGR slot disposed within 10 MGR after the start of picking, e.g. between 60 to 70 MGR. The monitor 11 transmits a corresponding signal to the loom control, the same receiving from an angle sensor (not shown) a signal for each degree of angular position of the loom main shaft. The control is programmed to stop the loom upon detection of a drive fault, the stoppage occurring after the rapiers have left the shed and after beating-up and shed-changing. The control also moves the pattern program back by one cycle and initiates a weft search in which the shed opens. The control clears the fault quite simply by a normal loom restart, the previously accidentally unpicked weft yarn, recognized as a "drive fault", being re-presented to the giver. After clearance of the cause of the fault the loom restarts. The fact that there is a drive fault is read off by the loom operator from the display of the corresponding angular position on the display screen indicating the operative position of the loom. The control can be so programmed that in the event of an unsuccessful effort to re-pick the missing weft yarn, after several stoppages of the loom and after several weft searches there is a further loom restart. The searches can be repeated until after a predetermined number of unsuccessful searches a warning signal is given for manual clearance of the fault by the loom operator.

2. "Giver mispick" fault

The term "giver mispick" denotes the fault wherein the giver rapier loses the weft yarn on its way to the center of the shed. There are two solutions according to the invention for clearing this fault and these two solutions are referred to here as "clamping" and "slipping".

Figure 2:
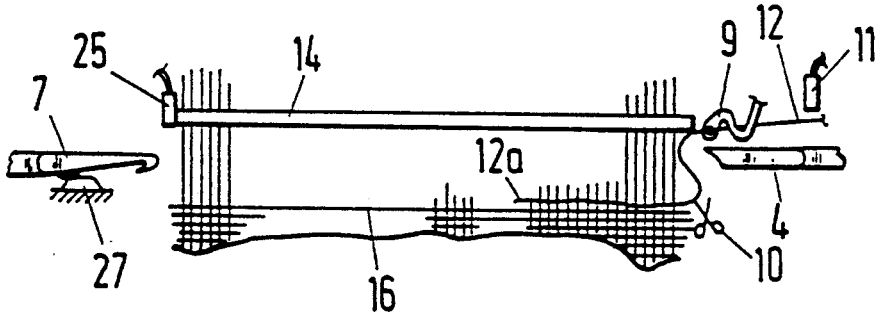
FIGS. 2 to 4 are front elevational views and show the clearing of "giver mispicks" by the "clamping" solution.
Figure 3:
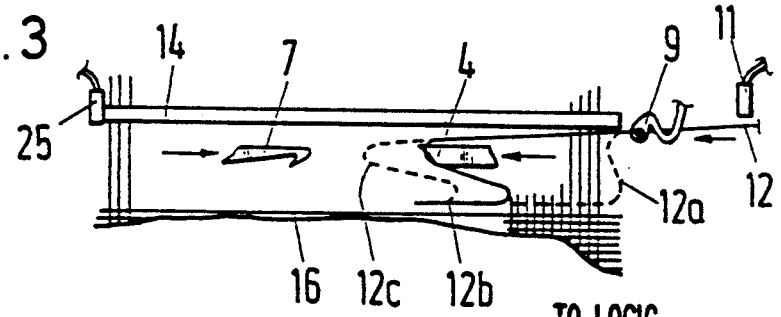
Figure 4:
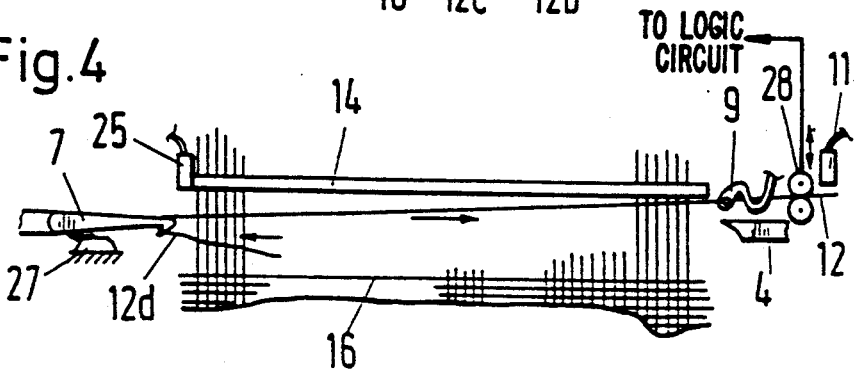

2.1 "Clamping" solution (FIGS. 2–4)

In the first solution the loom detects the fault in a fault-associated slot of the MGR position signals, the same being supplied continuously to the control during a loom cycle. This slot extends over approximately 10 MGR after the start of picking somewhere between approximately 60 and 140 MGR. The control detects from the combination of these signals with the missing yarn movement signal of the yarn detector 11 and the missing yarn presence signal of the yarn detector 25—which latter is operative between 300 and 340 MGR—that the giver rapier 4 has lost the weft yarn 2. By means of the missing yarn presence signal from the monitor 25 the control distinguishes this fault from the kinds of fault to be discussed hereinafter. A weft yarn piece 12*a* remains in the shed after beating-up (FIG. 2).

The control stops the loom, moves the rapiers back out of the shed, moves the loom program back by one cycle and initiates a weft search with "asynchronous shed adjustment", a term denoting that the shed is being opened and kept open for weft breakage clearance by means of a shedding mechanism adapted to be brought into operation independently of normal weaving. The shears 10 are rendered inoperative. The thrower 9 transfers the same weft yarn 12 to the giver rapier 4 again. During the entry of the giver into the shed yarn is additionally drawn off the bobbin 8, the yarn piece 12*a* simultaneously being peeled off the fell 16. FIG. 3 shows two intermediate positions 12*b*, 12*c* of the weft piece. At the center of the shed the taker rapier 7 takes over the weft yarn from the giver rapier 4. After both rapiers have moved back out of the shed the yarn end 12*d* (FIG. 4) is disposed loosely in the taker rapier 7 since the same opened upon striking the cam 27. Two yarn draw-back rollers 28 move towards one another and are rotated and draw the complete weft yarn out of the taker rapier and the shed, whereafter the loom restarts to resume weaving.

The aim of the asynchronous weft search is to have the shed open very wide when the rapiers move thereinto in order that the beaten-up weft yarn residues may be detached readily from the fell of the cloth. If the rapiers are still outside the shed the shedding unit, which is driven by the loom main shaft by way of a clutch, is declutched from the loom. The shedding unit is then rotated further by the inching motor of the loom to open the shed, whereafter the clutch is reengaged and the inching motor inches the rapiers into the shed. This occurs backwards—i.e., the main crank drive of the rapiers is turned backwards by the inching motor through approximately 280°. Consequently, at the restart after clearance of the fault the loom is once again in its programmed timing. The shedding movement during this operation is slight. At the center of the shed—i.e., at yarn transfer between the rapiers—the movement of the shedding unit stops and then reverses to prevent the shed closing in this position with the rapiers in it.

During the weft-searching step described the shears 10 move back and therefore make no severing movement. The events described apply to every kind of fault to be described hereinafter.

Figure 5:
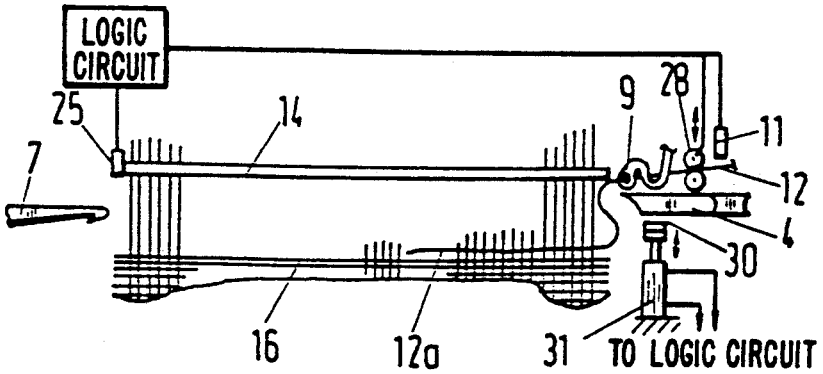
FIGS. 5 and 6 are front elevational views and show the clearing of "giver mispicks" by the "clamping" solution.
Figure 6:
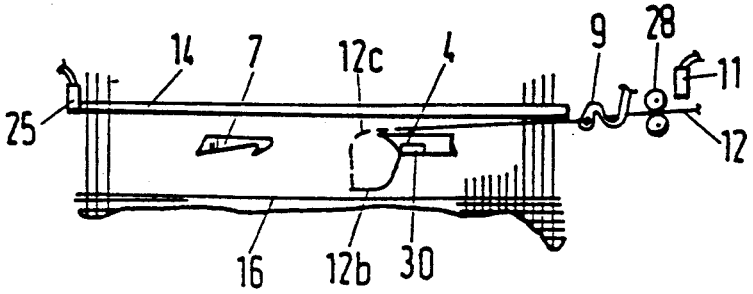

2.2 "Slipping" solution (FIGS. 5 and 6)

The procedure for this solution is the same as for the first "clamping" solution described in 2.1 as far as and inclusive of the asynchronous weft-searching step. In contrast to the first solution, however, in the "slipping" solution a slipping element 30, to be described hereinafter with reference to embodiments (FIGS. 33 and 34*c*, where the slipping element 30 is embodied by elements 65 and 80 respectively), is pushed on to the giver rapier 40 outside the shed. The element 30 is pushed on to the giver rapier automatically by means of a push-on device 31. While the draw-back rollers 28 are in the braking position, the thrower 9 re-presents the weft yarn 12 to the giver rapier 4. When the same moves into the shed the weft yarn piece 12*a* disengages from the fell 16 and slips through the slipping element 30. The presence thereof on the rapier prevents the yarn piece 12*a* from being caught by the clamp of the rapier 4. The taker rapier therefore cannot take over the yarn piece 12*a* since the same does not extend as far as the center of the shed. The draw-back rollers 28 move towards one another and rotate and draw the yarn piece 12*a* out of the shed 2. The yarn piece 12*a* is shown in two intermediate positions 12*b* and 12*c* during the draw-back. The loom restarts.

3. "Taker mispick" fault

The term "taker mispick" denotes the fault wherein after taking over the weft yarn from the giver rapier the taker rapier loses the weft yarn in its return movement. There are two solutions according to the invention, called "clamping" and "slipping", in the method of clearing this fault.

Figure 7:
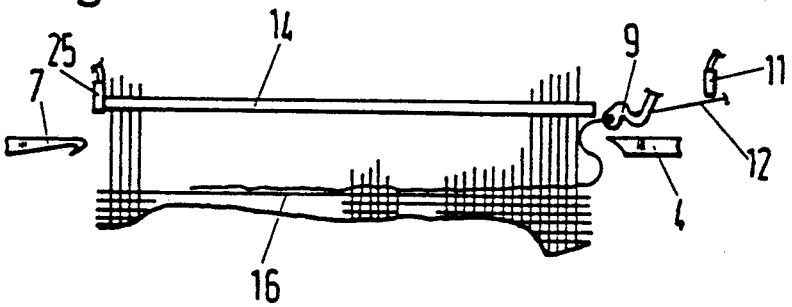
FIGS. 7 to 9 are front elevational views and show the clearing of "taker mispicks" by the "clamping" solution.
Figure 8:
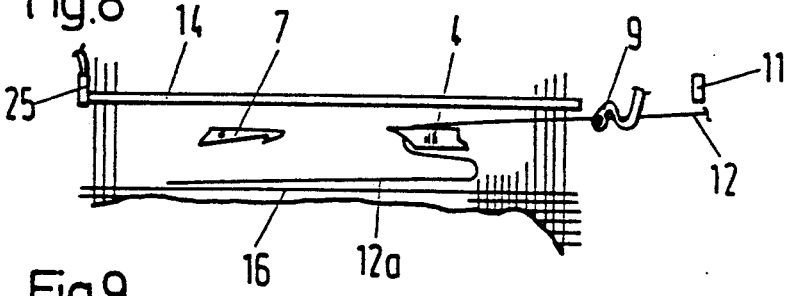
Figure 9:
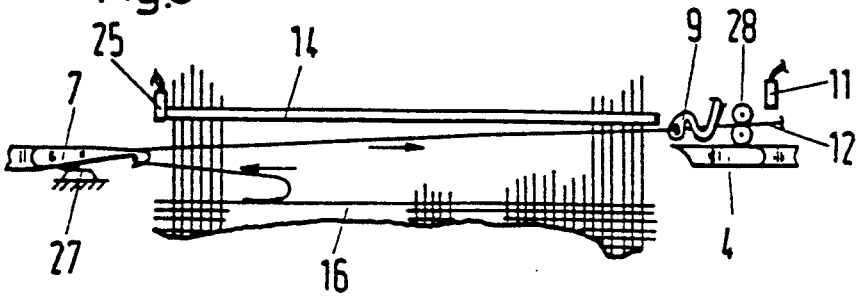
Figure 10:
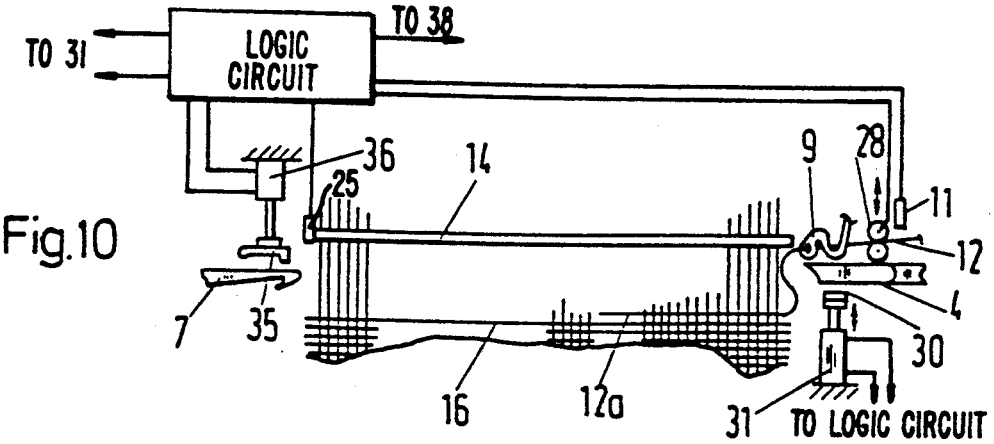
FIGS. 10 to 14 are front elevational views and show the clearing of "taker mispicks" by the "slipping" solution.

3.1 "Clamping" solution (FIGS. 7–9)

The procedure for this solution is as described in 2.1 for the "clamping" solution of the "giver mispick" fault. However, the MGR slot allocated to this particular fault lies within 130 to 160 MGR after the start of picking or between 190 and 320 MGR referred to the loom cycle if the 0° position is defined as hereinbefore described in connection with the "drive fault". A yarn piece 12*a* remains which extends as far as the taker side.

After the return of the rapiers an asynchronous weft search operation is made, the shears 10 being inoperative. The thrower 9 re-presents the weft yarn 12 to the giver rapier 4. When the same enters the shed yarn is additionally drawn off the bobbin 8 and the yarn piece 12*a* peeled off the fell 16. The taker rapier 7 takes the yarn piece over from the giver rapier and continues to release it from the fell 16. When the taker rapier 7 strikes its cam 27 it opens and the now operative draw-back rollers 28 draw the complete weft yarn out of the taker rapier and out of the shed (FIG. 9), whereafter the loom restarts. The only difference from the "clamping" solution for clearing the "giver mispick" fault is, therefore, that a longer yarn must be drawn back by way of the taker rapier 7.

3.2 "Slipping" solution (FIGS. 10–14)

Figure 11:
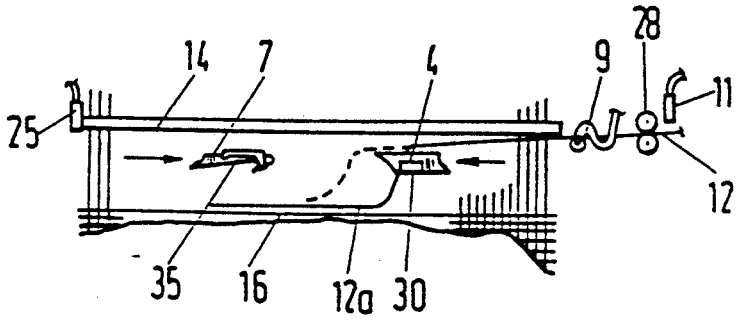
Figure 12:
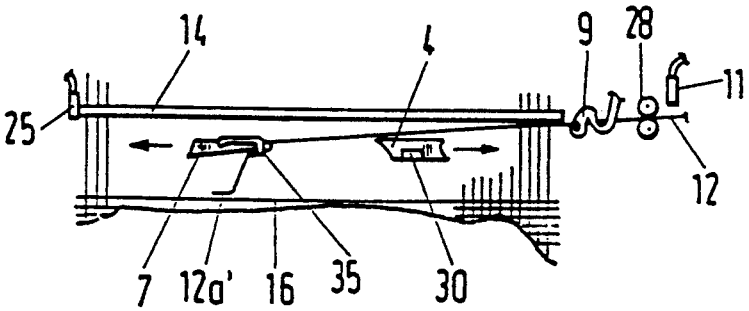
Figure 13:
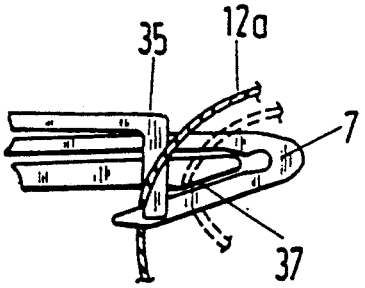
Figure 14:
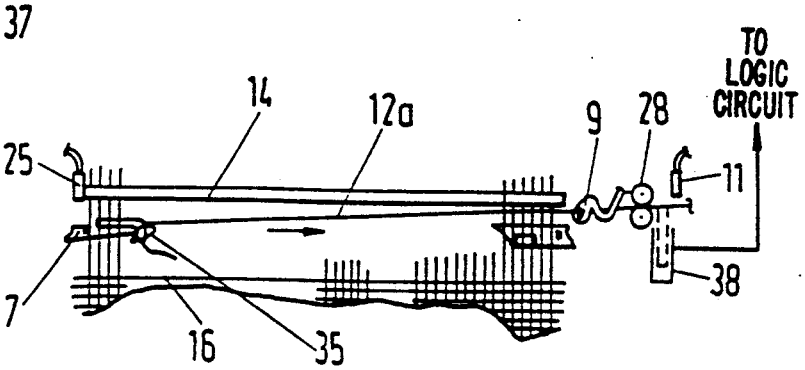
Figure 15:
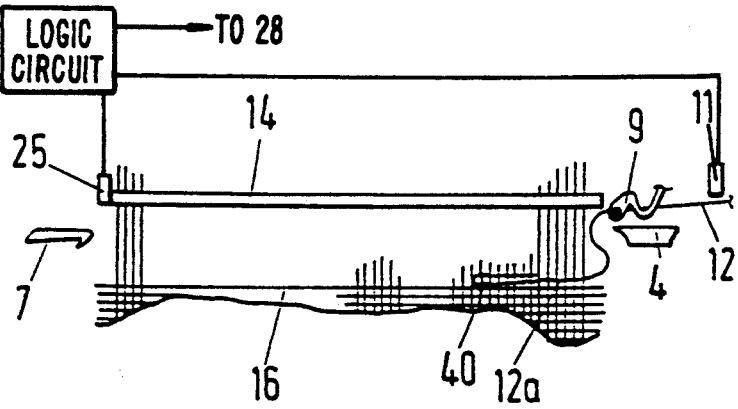
FIGS. 15 to 18 are front elevational views and show the clearing of "transfer faults" by the "clamping" solution.

The procedure in the second solution up to and including the pushing-on of the slipping element 30 is as described in 2.2 for the "giver mispick" fault. However, the MGR signal slot associated with this kind of fault lies within 130 to 260 MGR after the start of picking, corresponding to between 190 and 320 MGR of the loom cycle. In contrast to this solution, however, a slipping element 35 is pushed on to the taker rapier 7 by means of a push-on device 36 immediately after the taker rapier 7 is outside the shed 2. The element 35, which will be described hereinafter with reference to an embodiment, has a transfer function and a slipping function. The transfer function resides in the transfer by the taker rapier 7 of the weft yarn piece 12*a* from the giver rapier 4 without such yarn piece being caught by the clamp of the taker rapier 7. The same cannot therefore itself take over the yarn piece. The slipping function will be discussed in section 5. FIG. 11 shows the position of the giver rapier 4 and taker rapier 7 in the shed. The weft yarn 12 has been re-presented to the slipping element 30 and is now guided by way thereof with disengagement of the yarn piece 12*a* from the fell 16. The draw-back rollers 28 were in the braking position. The shears 10 are inoperative. After the slipping element 35 has taken over the yarn piece 12*a* from the slipping element 30 in the manner shown in FIG. 12, during the return of the taker 6 the yarn piece 12*a* slips over the slipping element 35 while the still unreleased part 12*a'* of the yarn piece 12*a* is disengaging from the fell 16. FIG. 13 illustrates the operation. As will be apparent in FIG. 13 the slipping element 35 prevents the weft yarn piece 12*a* from entering the clamp 37 of the taker rapier 7 so that the piece 12*a* can slip over the slipping element 35. Near the end of the return movement of the taker 6 (FIG. 14) the yarn piece 12*a* has already disengaged completely from the fell 16. The draw-back rollers 28 on the giver side are now started and the withdrawal of the mispicked weft yarn from the shed 2 begins. After the weft yarn has been fully withdrawn and extracted by a nozzle 38, the loom restarts.

4. Transfer faults

The term "transfer fault" denotes mistransfer of the weft yarn between the giver and the taker. For example, a loop 40 forms in the weft yarn piece near the fell. There are three solutions according to the invention for clearing the faults and they are known respectively as "clamping", "slipping" and "clamping variant".

4.1 "Clamping" solution (FIGS. 15–18)

Figure 16:
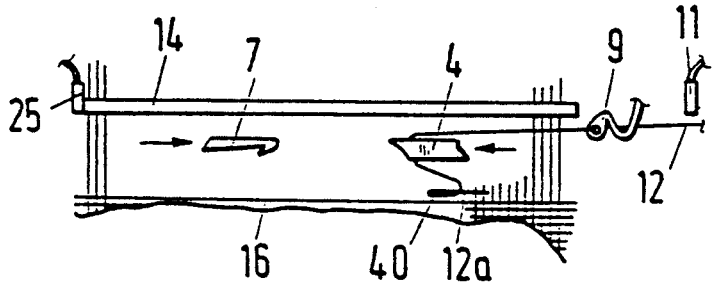
Figure 17:
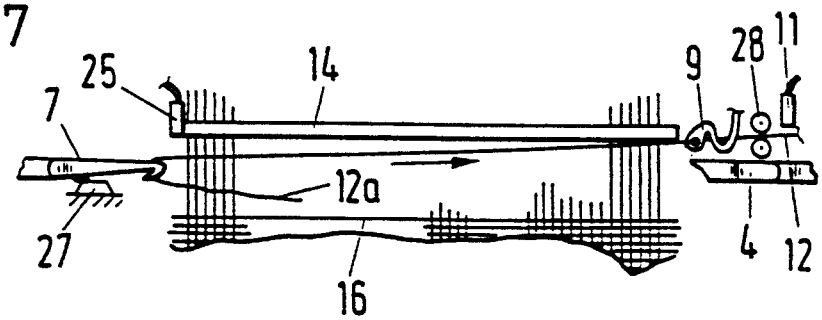
Figure 18:
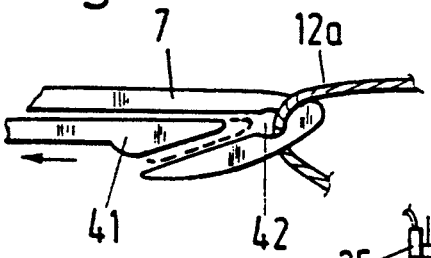

The procedure for this solution is the same as described in 2.1 for the "clamping-solution" of the "giver mispick" fault—i.e. transfer of the weft yarn back to the giver rapier 4 and picking of the weft yarn, the weft yarn piece 12*a* being detached from the fell simultaneously with the loop 40 (FIG. 16). After takeover of the yarn piece by the taker rapier and the return thereof from the shed, the yarn piece remains loosely in the open taker rapier 7 (FIG. 17). As is apparent in FIG. 18, a single opening movement of the taker rapier clamp 41 suffices to guide the yarn piece 12*a* into the yarn guide 42 of the rapier so that the yarn piece 12*a* experiences no clamping, whereafter the yarn is drawn by the draw-back rollers 28.

Figure 19:
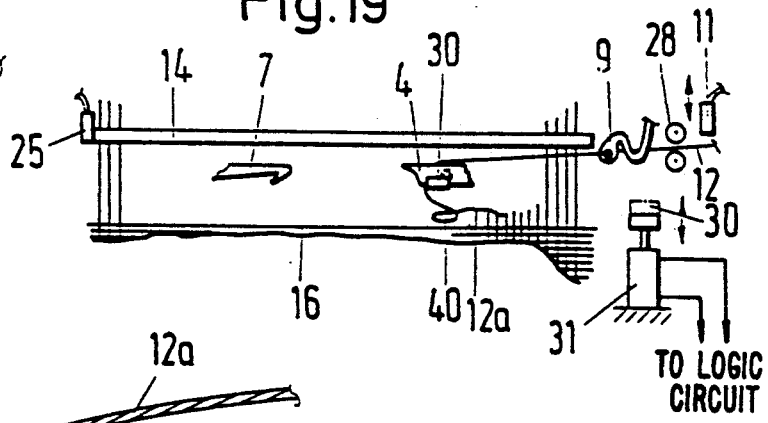
FIGS. 19 and 20 are front elevational views and show the clearing of "transfer faults" by the "slipping" solution.
Figure 20:
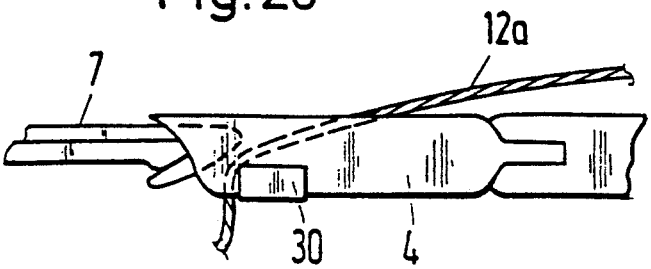

4.2 "Slipping" solution (FIGS. 19 and 20)

The procedure for this solution is the same as described in 2.2 for the "slipping" solution of the "giver mispick" fault. The yarn piece 12*a* is completely detached from the fell 16 even before the two rapiers 4, 7 meet. Since the weft length is approximately halved, the taker rapier 7 cannot engage the yarn piece (FIG. 20). Finally, the rollers 28 draw the yarn out of the shed.

Figure 21:
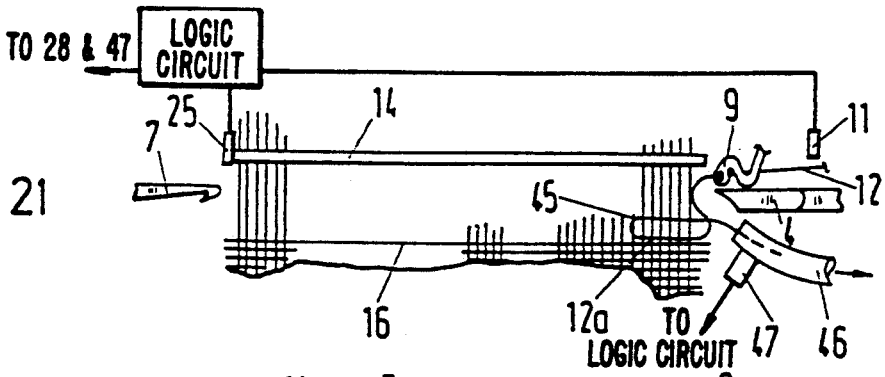
FIGS. 21 to 23 are front elevational views and show the clearing of "transfer faults" by the "clamping variant" solution.
Figure 22:
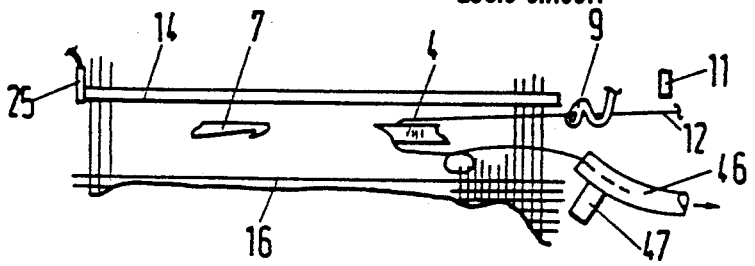
Figure 23:
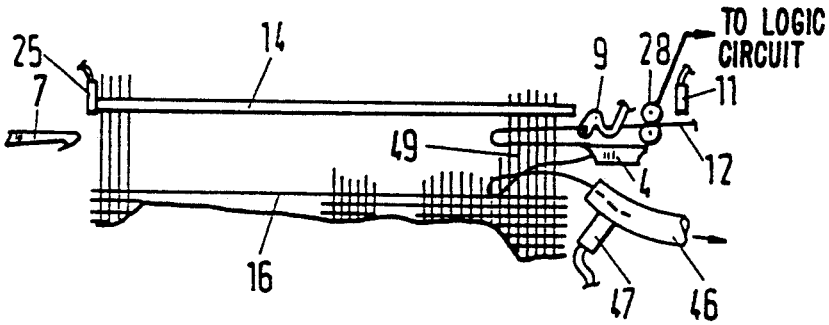

4.3 "Clamping variant" solution (FIGS. 21–23)

It may occur with a transfer fault that when the two rapiers meet at the center 19 of the shed the tip of the weft yarn 12 remains in the giver rapier 4 and, when the same returns, is pulled to some extent out of the shed and forms a loop 45. The MGR position signals associated with this kind of fault lie within approximately 130 to 160 MGR after the start of picking (between approximately 190 and approximately 320 MGR of the loom cycle). According to FIG. 21, to clear this fault a suction tube 46 is provided on the giver side, the inlet of the tube 46 being disposed near the giver rapier 4. A weft yarn monitor 47 is disposed in such inlet. The tube 46 sucks in the loop 45 in the yarn piece 12*a* as initiated by the monitor 47 for detecting this kind of transfer fault. Since the monitor 11 has previously detected absence of yarn movement, a signal from the monitor 11 has already initiated stoppage of the loom. The signal from the monitor 47 to the loom control initiates the following fault clearance operation.

The thrower 9 re-presents the weft yarn 12 to the giver rapier 4. The shears 10 are inoperative. The giver 3 moves backwards into the shed; as previously explained the rapier main crank drive is turned backwards in order to be in the programmed timing when the loom restarts after clearance of the fault. The control now so acts on giver movement that the giver does not reach the taker rapier 7 but reverses before reaching the center 19 of the shed, e.g. at 175 MGR, and moves out of the shed (see FIG. 22, although the rapiers therein are shown on their way to the reversal position). There can therefore be no transfer of yarn from the giver to the taker. Conventionally the yarn is transferred at approximately 180 MGR. Consequently, during the return of the giver the yarn remains engaged by the giver rapier 4. When the giver leaves the shed the giver yarn clamp is opened by the giver 4 striking its cam 48 (see FIG. 1). The draw-back rollers 28 are started, extend the yarn with the multiple loop 49 (FIG. 23) and draw the yarn piece 12*a* out of the shed. The loom restarts after clearance of the reason for the fault.

5. "Breakage before transfer" fault (FIGS. 24–28)

Figure 24:
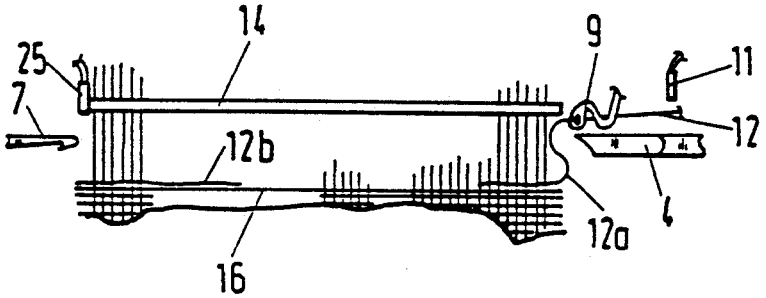
FIG. 24 is a front elevational view and shows "breakage before transfer" faults in which substantially equally long yarn pieces are disposed one on the giver side and one on the taker side.
Figure 25:
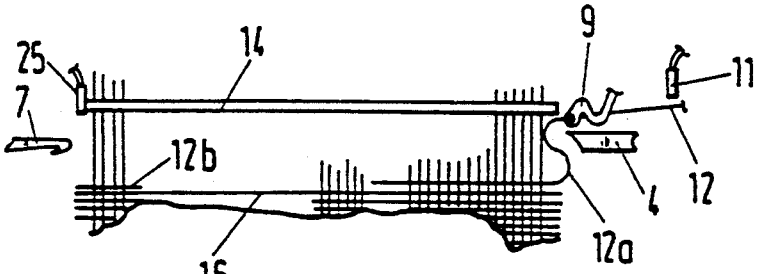
FIG. 25 is a front elevational view and shows the same kind of fault as FIG. 24 but with a longer yarn piece on the giver side than on the taker side.
Figure 26:
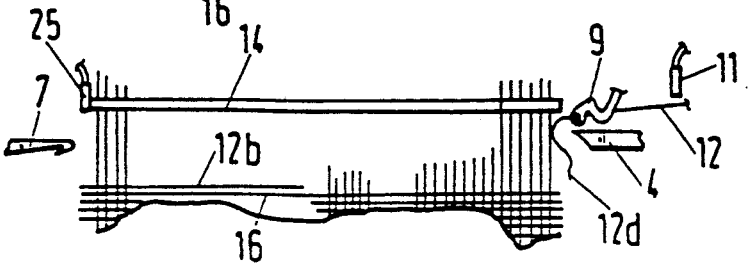
FIG. 26 is a front elevational view and shows the same kind of fault as shown in FIGS. 24 and 25 but with a yarn piece outside the shed on the giver side.

This fault occurs in three forms (as shown in FIGS. 24–26) which have the following common features:

The entire faulty length of weft yarn corresponds approximately to half the cloth width;

This half of the weft yarn length is divided into two parts 12*a* (or 12*d*) and 12*b*.

A relatively long weft yarn piece 12*b* was transferred to the taker rapier 7 from the giver rapier 4 and woven into the cloth by subsequent beating-up and shed changing. Also, the relatively long yarn piece 12a was woven into the cloth on the giver side (FIGS. 24 and 25) or a piece 12d remained unwoven outside the shed (FIG. 26).

The faults described are recognized as such first by the absence of yarn movement signal from the monitor 11 prior to yarn transfer at the center of the shed and second by the detection of yarn presence by the detector 25 on the taker side. In this case the monitor 11 is operative in the slot extending from 62° to 170° of the MGR position signals of a loom cycle (picking starts at 60° ) and the taker-side monitor 25 is operative in the slot extending from 300 to 340 MGR.

5.1 Solution for the giver side

To remove the yarn piece on the giver side the procedure is the same for all three kinds of fault as for the "giver mispick" fault described in the "clamping" section 2.1 or "slipping" section 2.2.

Advantageously, for the sake of consistency the same fault clearance program is gone through for the three kinds of fault—i.e., e.g. for the kind of fault according to claim 26 in which the yarn end 12d on the giver side has not been woven in at all, the program step for detaching the yarn from the fell is performed nevertheless.

5.2 Solution for the taker side

Figure 27:
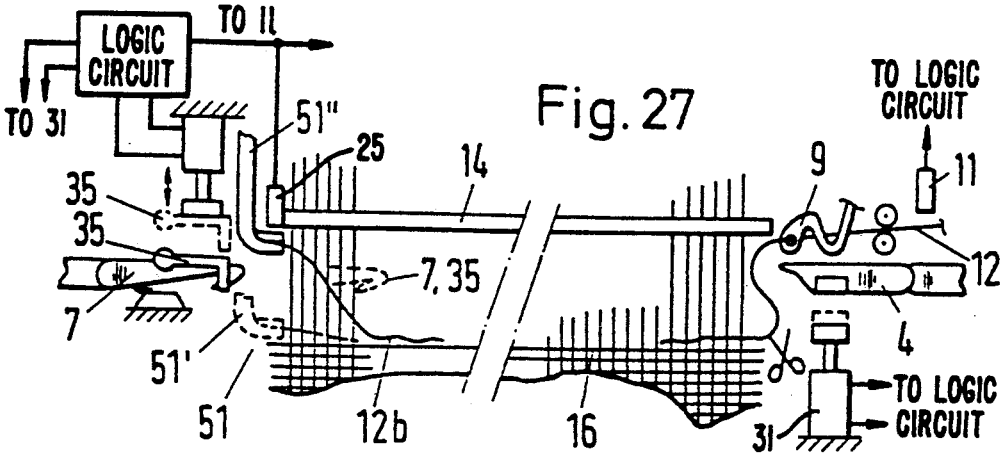
FIGS. 27 and 28 are front elevational views and show clearing of the kinds of fault shown in FIGS. 24 to 26.
Figure 28:
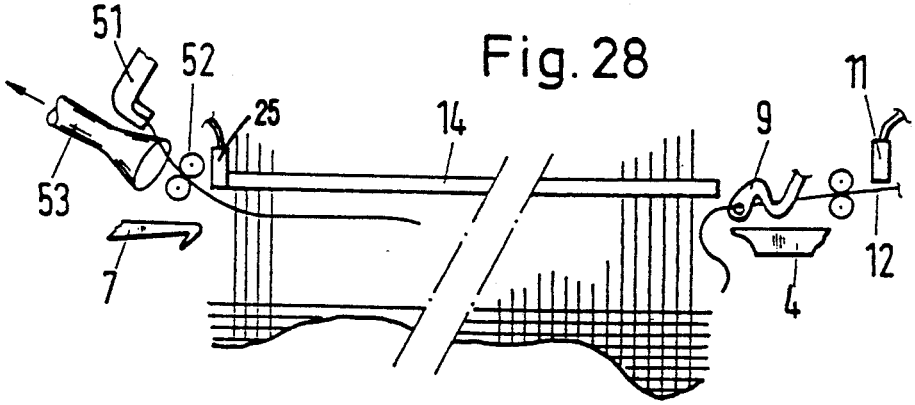

To remove the yarn piece 12b on the taker side the slipping element 35 of FIG. 13 is first pushed on to the taker rapier 7 by means of the push-on device 36, as shown in FIG. 27. There is a yarn clamp 51 on the taker side to catch the weft yarn piece 12b on the fell and then transfer it to the taker rapier. Also, a pair of draw-back rollers 52 are disposed on the taker side. To this end, the clamp 51 is moved from its position 51' into a position 51" so that the yarn piece 12b crosses the path of the taker. When the same enters the shed its rapier 7 engages the yarn piece 12b by way of the slipping element 35 and detaches such piece from the fell 16. When the taker rapier is outside the shed again after its return movement the yarn clamp transfers in its position 51" the yarn piece 12b to the draw-back rollers 52 which draw the yarn piece out of the shed (FIG. 28). In addition to or instead of the rollers 52 the yarn clamp 51 can transfer the yarn piece 12b to a suction nozzle 53.

Figure 30:
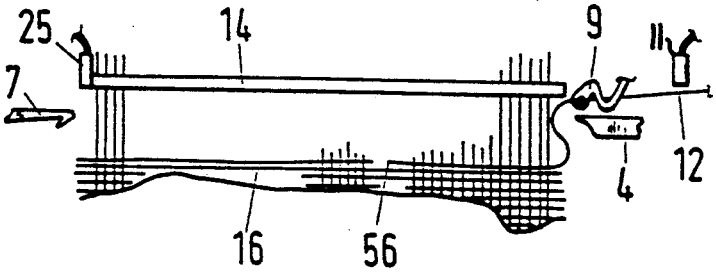
FIG. 30 is a front elevational view and shows the same kind of fault as FIG. 29 but with the breakage on the giver side.
Figure 31:
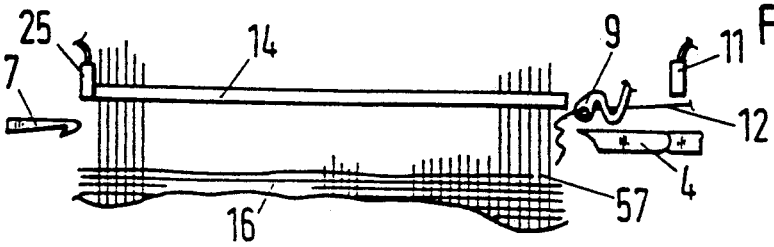
FIG. 31 is a front elevational view and shows the same kind of fault as in FIGS. 29 and 30 but with the breakage on the giver side outside the shed.

6. "Breakage after transfer" fault (FIGS. 29-31)

The term "breakage after transfer" denotes a fault wherein the weft yarn breaks after the taker has taken it over from the giver.

The MGR position slot allocated to this kind of fault extends over 130 to 250 MGR after the start of picking, corresponding to 190 to 320 MGR of the loom cycle. From the combination of these signals, viz. the missing yarn movement signal of the monitor 11 on the giver side and the yarn presence signal of the monitor 25 on the taker side, the control ascertains that the weft yarn broke after transfer. This fault can take three forms.

Figure 29:
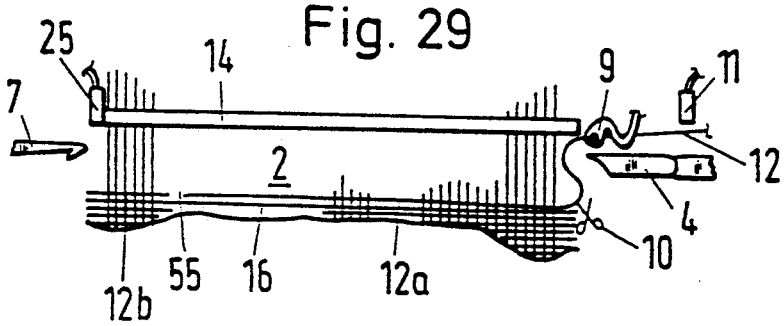
FIG. 29 is a front elevational view and shows the "breakage after transfer" fault, the breakage being on the taker side.

6.1 Solution for faults according to FIG. 29

Because of the breakage a weft yarn piece 12a is present in the shed 2 on the giver side and a yarn piece 12b on the taker side. The two pieces are separated from one another by the break 55. The same is on the taker side in FIG. 29. Consequently, the yarn piece 12b must be detached from the fell 16 on the taker side and drawn out of the shed. The requirement on the giver side is to detach the yarn piece 12a and draw it out of the shed.

The procedure for clearing this fault is the same as described for the "slipping" solution in section 3.2 for the "giver mispick" fault—i.e., pushing the slipping elements 30, 35 on to the giver rapier 4 and taker rapier 7 respectively, re-supply of the weft yarn 12 to the giver by the thrower 9, movement of the giver into the shed while the draw-back rollers 28 are in the braking position with detachment of the yarn piece 12a from the fell 16, and transfer of the yarn piece 12a to the slipping element 35 of the taker.

The yarn piece 12a residue remaining on the fell is detached therefrom by means of the slipping element of the taker 3 when the same moves out of the shed. The yarn piece 12b (FIG. 29) on the taker side is removed by means of the clamp 51 (FIG. 27) as described in section 5 for the "breakage before transfer" fault— i.e., the clamp 51 presents the yarn piece 12b to the taker rapier 4. When the taker enters the shed it detaches the yarn piece from the fell. After the return of the taker the clamp 51 transfers the yarn piece to draw-back rollers and/or an extraction nozzle for removal of the yarn piece.

6.2 Solution for faults according to FIG. 30

In FIG. 30 the break 56 is disposed substantially at the center of the shed and the two weft yarn pieces 12a, 12b are of approximately the same length.

The procedure for clearing this fault is the same as the fault clearance procedure described in section 6.1 for otherwise this fault cannot be distinguished from these two without great complexity.

6.3 Solution for faults according to FIG. 31

In FIG. 31 the break 57 is disposed on the fell on the giver side and the yarn piece 12a is outside the shed while the other yarn piece 12b is disposed substantially completely in the shed.

Figure 32:
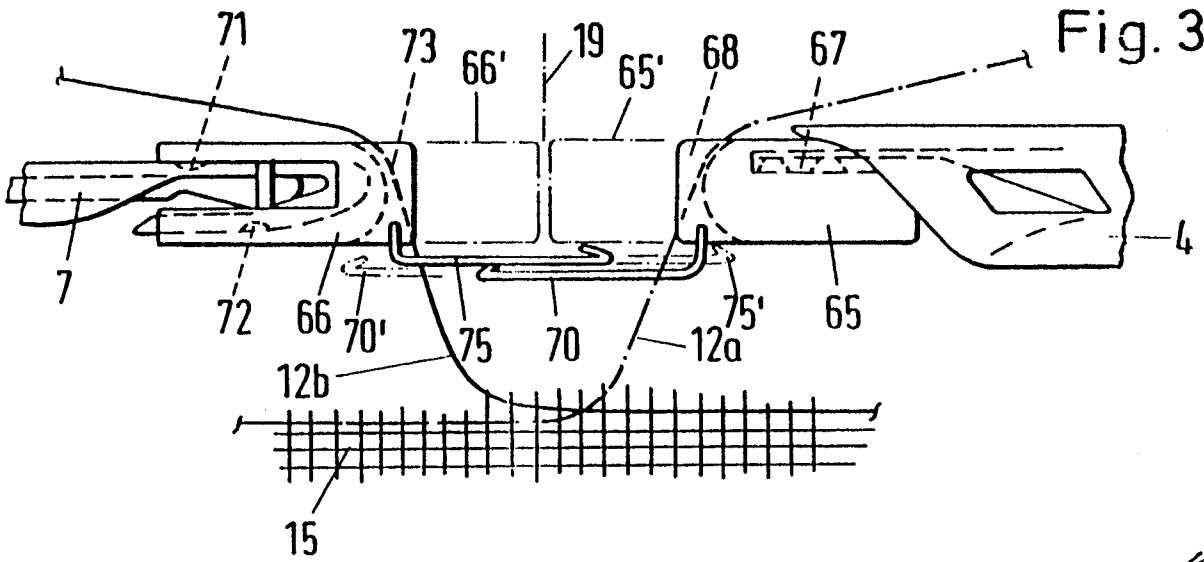
FIGS. 32 and 33 are perspective, side elevational views and show the cooperation between a slipping element on the giver rapier and a slipping element on the taker rapier.
Figure 33:
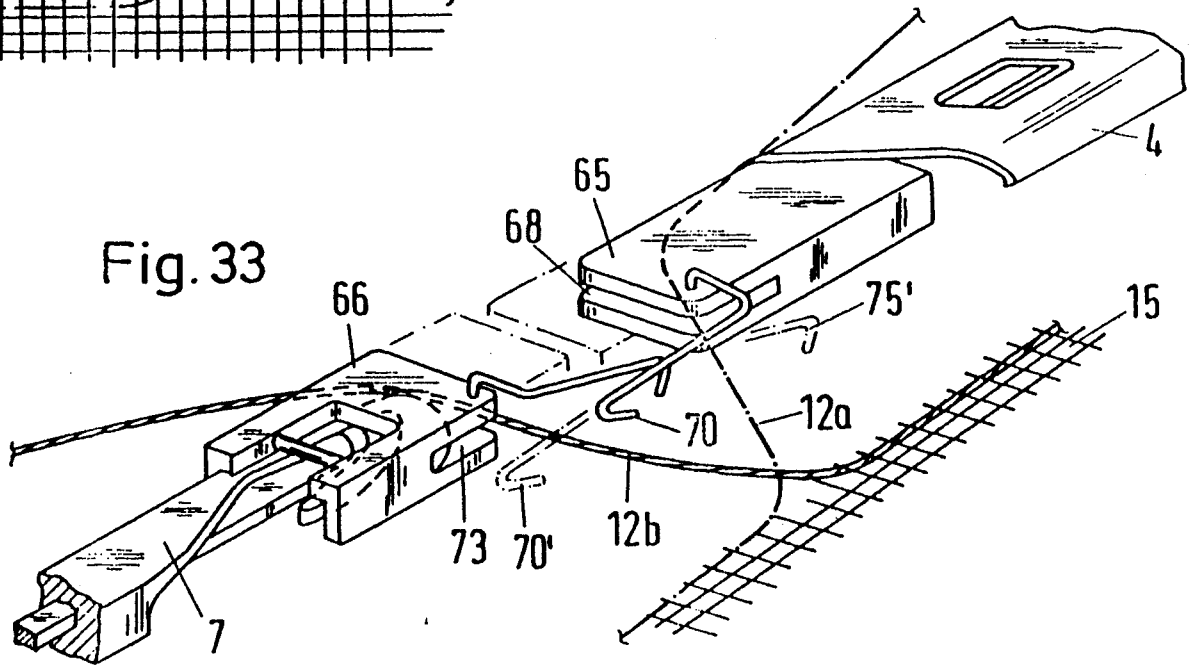

To clear this fault, for example, a slipping element 65 is pushed on to the giver rapier 4 and a slipping element 66 on to the taker rapier 7 (see FIGS. 32 and 33). When the giver 3 enters the shed the slipping element 65 is devoid of weft yarn. The weft yarn piece 12b was presented to the slipping element 65 by the clamp 51. Upon entering the shed the taker detaches the weft yarn from the fell 16 on the taker side. At the center of the shed the yarn is transferred from the taker rapier 7 to the giver rapier 4 by a yarn hook 70. In the return movement the yarn hook 70 detaches the weft yarn from the fell on the giver side.

FIGS. 32 and 33 show two cooperating slipping elements, viz. a slipping element 65 on the giver rapier 4 and a slipping element 66 on the taker rapier 7. The two slipping elements are shown shortly before their stationary position 65', 66' respectively in the shed at approximately 175 MGR. The giver slipping element 65 is pushed on to the giver rapier 4 and retained thereon by means of a snap fastening 67. The end face of the slipping element 68 is formed with a yarn-guiding groove 68. A yarn transfer hook 70 which extends in the forward direction is secured to the element 65 on the side near the cloth 15. The other slipping element 66 is pushed on to the taker rapier 7 and secured thereon by means of two snap fastenings 71, 72. The end face of the element 66 is formed with a groove 73. A yarn transfer hook 75 which extends in the forward direction is secured to the element 66 on the side near the cloth.

The operation of the slipping elements will be described for clearing the "taker mispick" fault by the "slipping" solution of section 3.2. Upon entry into the shed the slipping element 65 of the giver rapier 4 engages the yarn piece 12a, the latter being shown in chain-dotted line. While the giver is entering the shed the yarn piece 12a slips through the groove 68 in the slipping element 65 and is detached from the fell 16. When the slipping elements have reached their respective end positions 65', 66', the yarn hook 70 of the element 65 is in a position 70' indicated in chain-dotted line and the yarn hook 75 of the element 66 is in a position 75' indicated by a chain-dotted line. When the giver and the taker move apart from one another the yarn hook 75' catches the still unreleased yarn piece 12*a* and detaches it from the fell, the yarn piece 12*a* slipping through the yarn hook 75, 75' of the element 66.

FIG. 32 also shows the converse case in which the yarn hook 70, 70' of the giver rapier 4 would catch a yarn piece 12*b*, shown in solid line, presented by the taker rapier 7.

Figures 34A, 34B, 34C:
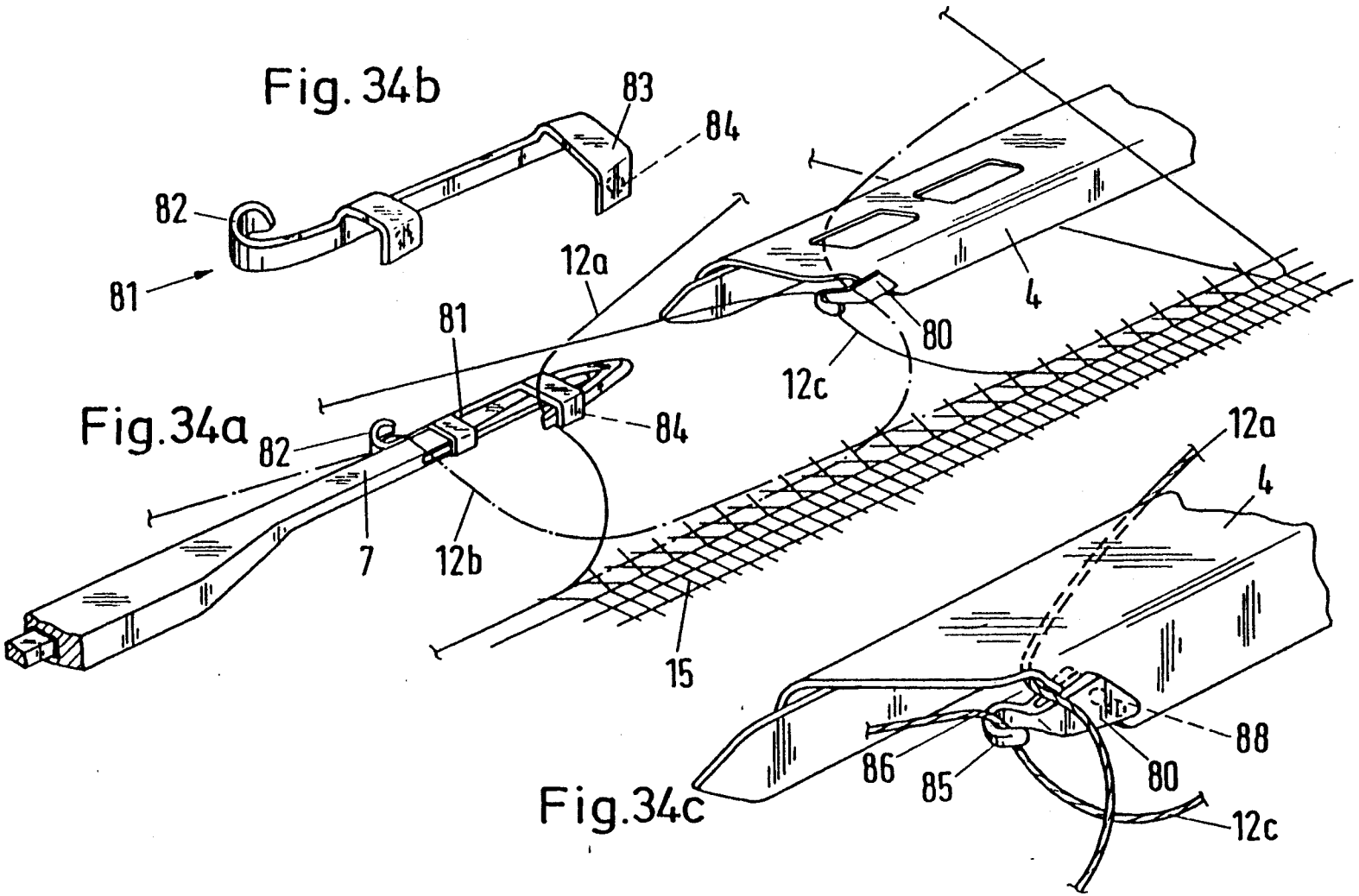
FIGS. 34*a*, 34*b* and 34*c* are perspective, side elevational views and show a second embodiment of slipping elements for the rapiers.

FIGS. 34*a*, 34*b* and 34*c*, which show variants of FIG. 33, illustrate the cooperation between transfer element 80 (snap fastening 88) pushed on to the giver rapier 4 and a slipping element 81 (snap fastening 84) pushed on to the taker rapier 7 for clearing the "break after transfer" fault in accordance with section 6.3, the break position 57 being disposed outside the shed on the giver side. Upon entry into the shed the transfer element 80 carries no weft yarn for the giver rapier. The slipping element 81 on the taker rapier has by way of its yarn hook 82 caught the yarn piece 12*b* presented by the yarn clamp 51. Upon entering the shed the taker rapier disengages the yarn piece 12*b* from the fell 16 on the taker side, the yarn slipping through the hook 82. On its return movement from the stationary position at approximately 175 MGR of the rapier, a yarn hook 85 (FIG. 34*c*) of the transfer element 80 on the giver rapier takes over the yarn piece 12*b* from the taker rapier and detaches the yarn piece 12*c* left on the giver side from the fell, the yarn slipping out of the yarn hook 82 of the element 81.

The slipping element 81 also has a weft yarn slipping hook 83 (FIG. 34*b*) whose purpose was described with reference to FIGS. 12 and 13. The slipping element 80 (FIG. 34*c*) forms on the giver rapier 4 a trough 86 for the slipping function in the "slipping" solutions hereinbefore described, the yarn 12*a* slipping through the trough 86.

Although the invention has been described in the foregoing for a single-shed rapier loom having rapiers moving into the shed in opposite directions, it is of use for a double-shed rapier loom and a two-web rapier loom. Also, the invention is of use in looms in which the rapiers enter the shed on only one side.

What is claimed is:

1. A method for clearing faults encountered during the operation of a rapier loom for weaving a cloth including weft yarn, with a last picked weft yarn on the cloth forming a fell, by searching for and removal of faulty weft yarn, the loom having a shed with a giver side and a taker side, a giver rapier at the giver side, a taker rapier at the taker side, and a rotating main shaft, the method comprising the steps of storing position signals in an electronic storage device for weft yarn faults which can occur at predetermined angular positions of the shaft during the operation of the loom so that the position signals can be used to identify the nature of weft yarn faults; monitoring the weft yarn; generating a weft yarn monitor signal when a faulty weft yarn is detected; and comparing the monitor signal with the position signals in a logic circuit to thereby determine the nature of a fault.

2. A method according to claim 1 including the step of clearing a drive fault, and wherein the monitoring step comprises detecting an absence of weft yarn movement on the giver side, generating a corresponding monitor signal, and thereafter presenting and picking the weft yarn.

3. A method according to claim 2 wherein the monitoring step following the presenting and picking steps includes the step of again detecting the absence of weft yarn movement on the giver side, and re-presenting and re-picking the weft yarn.

4. A method according to claim 3 wherein the monitoring step includes at least one additional step of detecting the absence of weft yarn movement at the giver side following the re-presenting and re-picking steps, and thereafter including the step of arresting the operation of the loom and generating a warning signal for the manual clearance of the detected drive fault.

5. A method according to claim 2 wherein the position signal for the detected drive fault relates to angular positions of the main shaft within 10° following commencement of picking.

6. A method according to claim 1 wherein the step of monitoring includes detecting an absence of weft yarn movement at the giver side and the taker side of the loom; and including the steps of clearing the fault by presenting and picking the weft yarn while detaching it from the fell; transferring the presented and picked weft yarn to the taker rapier; returning the rapiers to their respective loom sides; opening the taker rapier; and thereafter drawing the weft yarn from the open taker rapier and out of a shed of the loom.

7. A method according to claim 1 wherein the step of monitoring includes detecting an absence of weft yarn movement at the giver side and the taker side of the loom; and including the steps of clearing the fault by applying a slipping element of the giver rapier which slippingly engages a faulty weft yarn piece and thereby prevents its transfer by the giver rapier to the taker rapier; moving the rapiers into a shed of the loom to thereby detach the faulty weft yarn piece from the fell on the giver side; and drawing the faulty weft yarn piece out of the shed.

8. A method according to claims 6 or 7, wherein position signals for the fault being cleared relate to angular positions of the main shaft between 10° after the commencement of picking and the rotational position of the main shaft where a yarn transfer between the rapiers takes place.

9. A method according to claim 1 wherein the monitoring step comprises detecting an absence of yarn movement at the giver side and an absence of yarn presence at the taker side; and including the step of clearing the fault by presenting and picking the mispicked weft yarn while detaching a piece thereof from the fell on the taker side; transferring the mispicked weft yarn to the taker rapier; separating another piece of the weft yarn from the fell on the taker side; thereafter opening the taker rapier; and withdrawing the mispicked weft yarn from the open taker rapier and the shed.

10. A method according to claim 1 wherein the step of monitoring comprises the step of detecting an absence of weft yarn movement on the giver side and an absence of weft yarn presence at the taker side; and including the step of clearing the fault by applying a slipping element to the giver rapier and to the taker rapier; holding a faulty weft yarn piece at the giver side with the slipping element on the giver rapier while moving the giver rapier into the shed to thereby detach the faulty weft yarn piece from the fell at the giver side; transferring the faulty weft yarn piece from the slipping element on the giver rapier to the slipping element on the taker rapier; moving the taker rapier out of the shed to thereby detach a remainder of the faulty weft yarn piece from the fell at the taker side; moving the giver rapier out of the shed; and withdrawing the faulty weft yarn piece from the slipping element on the taker rapier and the shed.

11. A method according to claim 1 wherein the step of monitoring comprises detecting an absence of weft yarn movement on the giver side, an absence of yarn presence at the taker side, and a presence of an end of the weft yarn at the giver side, and including the step of clearing the fault by presenting and picking the mistransferred weft yarn while detaching it from the fell and preventing its transfer from the giver rapier to the taker rapier; returning the giver rapier to the giver side; thereafter opening the giver rapier; and withdrawing the mistransferred weft yarn from the giver rapier and the shed.

12. A method according to claim 11 wherein the step of clearing the fault includes the step of temporarily moving a rapier backwards relative to its normal direction of movement to prevent the mistransferred weft yarn from being severed from a supply of weft yarn prior to clearing the fault.

13. A method according to claim 11 wherein the step of clearing comprises the step of reversing movement of the giver rapier and the taker rapier while they are in the shed at an angular position of the main shaft of approximately 5° before the rapiers reach their respective transfer positions.

14. A method according to claim 1 wherein the step of monitoring includes the step of detecting an absence of weft yarn movement on the giver side and a presence of weft yarn on the taker side; and including the step of clearing the fault by presenting weft yarn to the giver rapier and picking it while detaching a broken weft yarn piece from the fell at the taker side of the loom; transferring the yarn piece from the giver rapier to the taker rapier; returning the rapiers to their respective loom sides; opening the giver rapier and withdrawing the weft yarn piece to the giver side after a return of the rapiers to the respective loom sides; attaching a slipping element to the taker rapier; and presenting a faulty weft yarn piece on the taker side to the slipping element on the taker rapier, moving the taker rapier into the shed while detaching the faulty weft yarn piece on the taker side from the fell, and, following a return of the taker rapier to a position outside the shed, withdrawing the faulty weft yarn piece at the taker side from the slipping element and the shed.

15. A method according to claim 1 wherein the step of monitoring comprises the step of detecting an absence of yarn movement on the giver side and a presence of yarn on the taker side; and including the step of clearing the fault by attaching a slipping element to the giver rapier and the taker rapier; presenting a weft yarn piece at the giver side to the slipping element on the giver rapier and picking said weft yarn piece while detaching it from the fell at the taker side; presenting another weft yarn piece at the taker side to the slipping element on the taker rapier; moving the taker rapier into the shed while detaching the another weft yarn piece at the taker side from the fell; and withdrawing the another weft yarn piece from the slipping element on the taker rapier and the shed after a return of the taker rapier to a position outside the shed.

16. A method according to claim 1 wherein the step of monitoring comprises detecting an absence of weft yarn movement at the giver side and a presence of weft yarn on the taker side; and including the step of clearing the fault by attaching a slipping element to the giver rapier and the taker rapier; picking the first weft yarn piece on the giver side with the slipping element while detaching it from the fell at the giver side; transferring the first weft yarn piece from the giver rapier to the taker rapier at a center of the shed; with the slipping element on the taker rapier detaching a portion of the second weft yarn piece on the taker side from the fell during a return movement of the taker rapier to a position outside the shed; thereafter withdrawing the first weft yarn piece from the slipping element on the taker rapier and from the shed; and withdrawing the second weft yarn piece from the shed.

17. A method according to claim 1 wherein the step of monitoring comprises the step of detecting an absence of yarn movement at the giver side and a presence of yarn at the taker side of the loom; and including the step of clearing the fault by attaching to each of the giver rapier and to the taker rapier a yarn slipping element; presenting the weft yarn piece at the taker side to the slipping element on the taker rapier; moving the giver rapier without a weft yarn into the shed; moving the taker rapier into the shed while detaching said weft yarn piece from the fell at the taker side; at a center of the shed transferring said weft yarn piece from the slipping element on the taker rapier to the slipping element on the giver rapier; returning the giver rapier to the giver side; detaching another weft yarn piece from the fell on the giver side thereof; returning the rapiers to positions outside the shed; and withdrawing the weft yarn piece from the slipping element on the taker rapier and the shed.

18. A method according to claims 9, 10, 11, 16 or 17 wherein the position signals for the faults to be corrected are generated when the angular position of the main shaft of the loom is between approximately 10° following the weft yarn transfer position between the rapiers and the end of the picking step.

19. A rapier loom for clearing faults, including weft yarn mispicks, mistransfers, broken weft yarn and drive faults, encountered during the operation of the loom by searching for faulty weft yarn segments and removing said weft yarn segments, the loom comprising a rotating main drive shaft; a shed defining a giver side and a taker side; a giver rapier and a taker rapier movable into and out of the shed; a weft yarn monitor on the giver side and a weft yarn monitor on the taker side for monitoring the weft yarn and generating a monitor signal when a fault is detected; means for withdrawing faulty weft yarn segments from the shed; electronic storage means storing position signals indicative of weft yarn faults which can occur at predetermined angular positions of the main shaft so that the position signals relate to the nature of weft yarn faults; and logic circuit means operatively coupled with the electronic storage means and the weft yarn monitors for comparing the monitor signals with the position signals and for initiating corrective steps by the loom to eliminate the detected fault.

20. A rapier loom according to claim 19 including means for clearing a weft yarn break on the taker side of the loom after transfer of the weft yarn from the giver rapier to the taker rapier, a slipping element for each rapier, the slipping elements having end faces including a weft yarn guide groove and, on their sides proximate a cloth being woven by the loom, a respective weft yarn hook, each hook extending from the associated slipping element as far as the other slipping element when in a weft yarn transfer position.

21. A loom according to claim 19 including means for clearing a weft yarn break on the giver side after transfer of the weft yarn from the giver raper to the taker rapier, a slipping element for the giver rapier formed as a transfer element including a weft yarn transfer hook adapted to serve as a slipping element, and a slipping element on the taker rapier including a weft yarn gripping hook and a weft yarn slipping hook.

* * * * *